US009724586B2

(12) United States Patent
Smith et al.

(10) Patent No.: US 9,724,586 B2
(45) Date of Patent: Aug. 8, 2017

(54) BALANCE TRAINER

(71) Applicant: TRIM LINE SPORTS LLC, Melbourne, FL (US)

(72) Inventors: Dan Smith, Melbourne, FL (US); James Blakeney, Wakefield, RI (US)

(73) Assignee: TRIM LINE SPORTS LLC, Melbourne, FL (US)

( * ) Notice: Subject to any disclaimer, the term of this patent is extended or adjusted under 35 U.S.C. 154(b) by 0 days.

(21) Appl. No.: 15/135,114

(22) Filed: Apr. 21, 2016

(65) Prior Publication Data

US 2016/0310792 A1 Oct. 27, 2016

Related U.S. Application Data

(60) Provisional application No. 62/150,487, filed on Apr. 21, 2015.

(51) Int. Cl.
*A63B 22/16* (2006.01)
*A63B 69/00* (2006.01)

(52) U.S. Cl.
CPC ..... *A63B 69/0093* (2013.01); *A63B 22/16* (2013.01); *A63B 2225/62* (2013.01)

(58) Field of Classification Search
USPC ..... 482/1–148
See application file for complete search history.

(56) References Cited

U.S. PATENT DOCUMENTS 5,062,629 A * 11/1991 Vaughan ..... A63B 22/18 482/147
5,351,637 A * 10/1994 Brenckmann ..... B63B 35/7913 114/39.14
6,168,551 B1 * 1/2001 McGuinness ..... A63B 69/0093 434/247
7,300,392 B1 * 11/2007 Curran ..... A63B 21/0004 482/146
7,566,291 B2 * 7/2009 Lickle ..... A63B 69/0093 482/146
7,662,006 B2 * 2/2010 Mollis ..... B63B 35/7913 114/357
7,670,265 B1 * 3/2010 Forrest ..... A63B 69/0093 482/146
7,686,751 B2 * 3/2010 Carlson ..... A63B 69/0066 482/146
8,734,308 B1 * 5/2014 Joslin ..... A63B 22/16 482/142
8,834,220 B2 * 9/2014 Haller ..... B63B 35/79 114/140
9,114,862 B2 * 8/2015 Dingel ..... B63B 35/7913
2003/0153221 A1 * 8/2003 Weir ..... B63B 35/7913 441/66
2007/0155495 A1 * 7/2007 Goo ..... A63B 24/0003 463/36
2009/0049757 A1 * 2/2009 Potter ..... B64C 3/30 52/2.23

(Continued)

*Primary Examiner* — Stephen R Crow
(74) *Attorney, Agent, or Firm* — David Yohannan; Quarles & Brady LLP

(57) ABSTRACT

A balance trainer set including an inflatable balance board and an inflatable balance roller are disclosed. The inflatable balance board may have a flat, or slightly curved profile taken along a longitudinal centerline and/or a lateral centerline.

15 Claims, 4 Drawing Sheets

(56) References Cited

U.S. PATENT DOCUMENTS

| | | | | |
|---|---|---|---|---|
| 2015/0147926 | A1* | 5/2015 | Trockel | B29C 67/0051 441/66 |
| 2015/0251056 | A1* | 9/2015 | Crist | A63B 22/18 482/146 |
| 2016/0114866 | A1* | 4/2016 | Pendle | B63B 35/7906 441/66 |
| 2016/0310792 | A1* | 10/2016 | Smith | A63B 22/16 |

* cited by examiner

BALANCE TRAINER

CROSS REFERENCE TO RELATED APPLICATIONS

This application relates to, and claims the benefit of the earlier filing date and priority of U.S. Provisional Patent Application No. 62/150,487, filed on Apr. 21, 2015, entitled "IFITBOARD."

FIELD OF THE INVENTION

The present invention relates generally to exercise and balance training equipment.

BACKGROUND OF THE INVENTION

Balance training provides a great way to improve coordination, core strength and balance for sports such as surfing, snowboarding, and the like. Typically, a balance trainer may include a balance board to stand upon and an underlying structure that provides the balance board with limited stability. The balance board may include an upper surface having a dimension sufficient to permit a person to stand thereon with her feet spread apart in a "balancing" stance. Instead of resting on the ground or a floor, the board may rest on a pivot structure, such as a cylindrical roller that permits the board to statically pivot on the roller, as well as dynamically roll forward and backward over the roller in response to the balancing maneuvers and exercises of the user.

Because balance boards and rollers have been made of wood and hard plastics, they can be intimidating for novices and children since they are relatively heavy and have slick, low-friction surfaces, enabling the board to accelerate forward and backward on the roller quickly. A balance board or roller over which a user loses control may shoot forward or backward at a high speed, causing damage to surrounding structures and/or injury to the user and surrounding persons. Accordingly, there is a need for a balance board and roller set which is lighter and less prone to quick forward and backward accelerations than those currently used.

Typical balance boards and rollers made of wood and hard plastics may also be unwieldy to transport and store, as well as heavy for young and smaller users to carry. For example, a balance board may be more than 30 inches long, more than 15 inches wide and 1 or more inches thick. When made of wood or heavy plastic, this structure can be difficult for a young or smaller user to lift, carry and manipulate. Since the wood or heavy plastic boards and rollers have fixed dimensions, they can also be prohibitively heavy and large for travel. Accordingly, there is a need for a balance board and roller set which is lighter to carry and capable of being packed and stored conveniently.

Existing balance boards and rollers made of wood or heavy plastic also lack adjustability to match various skill levels, user weights and intended uses. Currently used balance boards and rollers, are of fixed dimensions, and thus in order to adjust the size or shape of the board and/or roller to accommodate different user skills and sizes, a different board or roller must be used, adding not only complexity for use, travel and storage, but also adding expense. Accordingly, there is a need for a balance board and roller set which provides some level of adjustability for users of different ages, weights, heights and skill levels.

Accordingly, it is an object of some, but not necessarily all, embodiments of the present invention to provide a balance board and/or roller that accelerate forward and backward less quickly than those used previously. It is also an object of some, but not necessarily all, embodiments of the present invention to provide a balance board and/or roller which is lighter to carry and more capable of being packed and stored conveniently than existing boards and rollers. It is also an object of some, but not necessarily all, embodiments of the present invention to provide a balance board and/or roller that provides some level of adjustability for users of different ages, weights, heights and skill levels.

SUMMARY OF THE INVENTION

Responsive to the foregoing challenges, Applicant has developed an innovative inflatable balance board and inflatable roller set comprising:

- the inflatable board having:
  - a first surface extending between nose, tail, right rail and left rail portions of the board, wherein the first surface is slightly curved along a section extending between the nose and the tail portions from a lateral centerline when the board is fully inflated without the weight of a user being applied thereon,
  - a second surface opposing the first surface and substantially the same dimension as the first surface, wherein a minimum distance between opposing central portions of the first surface and the second surface define a board thickness when the board is fully inflated without the weight of a user being applied thereon,
  - an outer edge extending along a perimeter of the board between the first surface and the second surface,
  - an airtight interior board chamber disposed between the first surface, the second surface, and the outer edge, and
  - a first air inflation/deflation valve extending from an ambient to the airtight interior board chamber;
  - wherein the first and second surfaces are adapted to support the weight of a user when the board is placed against the inflatable roller; and
- the inflatable roller having:
  - a generally cylindrical body when the roller is fully inflated, wherein a minimum diameter of the roller when the roller is fully inflated defines a roller diameter,
  - first and second ends disposed at opposite ends of the generally cylindrical body,
  - an airtight interior roller chamber disposed inside the generally cylindrical body between the first and second ends, and
  - a second air inflation/deflation valve extending from an ambient to the airtight interior roller chamber; and wherein the cylindrical body is adapted to support the weight of a user and the board.

Applicant has further developed an innovative inflatable balance board comprising:

- a first surface extending between nose, tail, right rail and left rail portions of the board, wherein the first surface is slightly curved along a section extending between the nose and the tail portions from a lateral centerline when the board is fully inflated without the weight of a user being applied thereon;
- a second surface opposing the first surface and substantially the same dimension as the first surface;
- an outer edge extending along a perimeter of the board between the first surface and the second surface;
- an airtight interior board chamber disposed between the first surface, the second surface, and the outer edge; and a first air inflation/deflation valve extending from an ambient to the airtight interior board chamber;

wherein a radius of curvature of the board is in the range of 48 to 240 inches.

It is to be understood that both the foregoing general description and the following detailed description are exemplary and explanatory only, and are not restrictive of the invention as claimed.

BRIEF DESCRIPTION OF THE DRAWINGS

In order to assist the understanding of this invention, reference will now be made to the appended drawings, in which like reference characters refer to like elements. The drawings are exemplary only, and should not be construed as limiting the invention.

DETAILED DESCRIPTION OF EMBODIMENTS OF THE INVENTION

Figure 1:
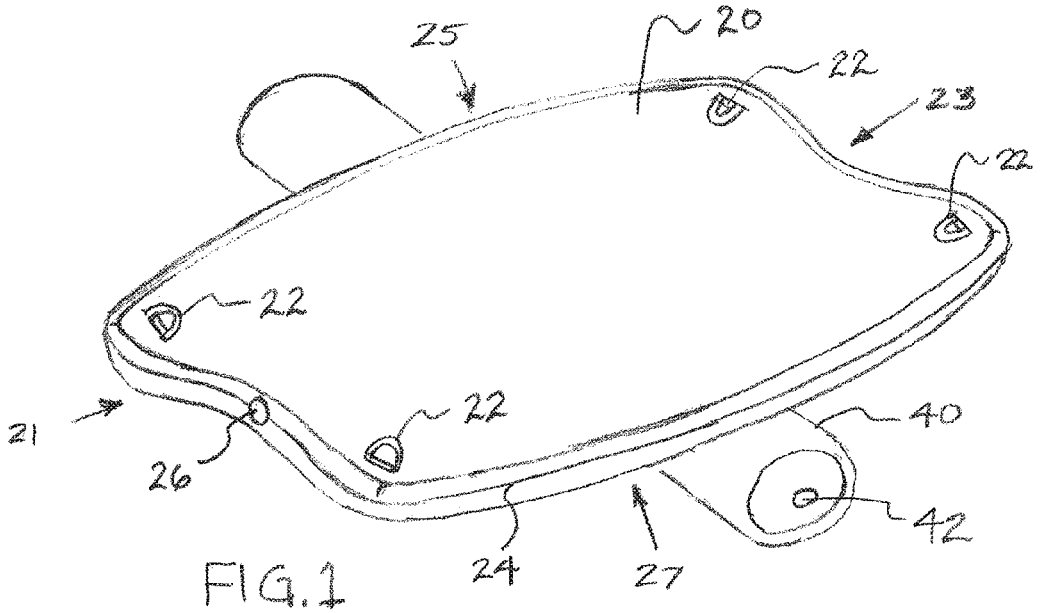
FIG. 1 is a pictorial view of a balance board and roller set in accordance with a first embodiment of the present invention.

Reference will now be made in detail to embodiments of the present invention, examples of which are illustrated in the accompanying drawings. With reference to FIG. 1, in a first embodiment of the invention, a balance trainer set includes an inflatable board 20 and an inflatable roller 40. Both the inflatable board 20 and the inflatable roller 40 may be constructed of high-pressure inflatable materials, such as drop-stitch inflatable materials, which permit the board and the roller to be rigid when inflated. Such material is also durable, yet soft and user friendly permitting the board and roller to be folded and/or rolled up when deflated.

The board 20 may include a first upper surface adapted to have a person (user) stand, kneel or sit thereon, and an opposing second lower surface adapted to rest on a surface, such as a floor, or more preferably to rest at least in part on the roller 40, which in turn rests on a surface such as a floor. The board may have a contiguous outer edge 24 extending along a perimeter of the board between the upper and lower board surfaces that defines the outer bounds of the upper and lower board surfaces. For example, in the embodiment shown in FIGS. 1 and 2, the board 20 includes an outer edge 24 that defines four portions of the board—a nose portion 21, a tail portion 23, a right rail portion 25, and a left rail portion 27. The nose and tail portions 21 and 23 may be scalloped or curved when viewed from above (FIG. 2), for example as shown with slightly outwardly bowed outer edges and a slightly recessed mid-portions. The right and left rail portions 25 and 27 may also be scalloped or curved when viewed from above, for example as shown with slightly outwardly bowed edges extending from the nose and tail portions 21 and 23 to the mid-portions of the right and left rails.

Figure 3:
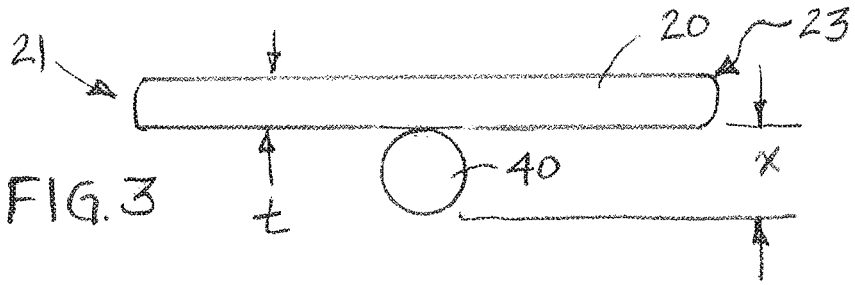
FIG. 3 is a side cross sectional view of the balance board and roller set shown in FIGS. 1 and 2 while in a full inflation state.

The lower surface of the board 20 and the opposing upper surface may have substantially the same dimensions, and each may have a longitudinal centerline L and a lateral centerline C. The lower surface of the board 20 may be separated from the upper surface by a relatively constant amount, at least over the opposing central portions of the two surfaces. With reference to FIG. 3, the minimum distance between opposing central portions of the upper surface and the lower surface of the board 20 may define a board thickness t when the board is fully inflated without the weight of a user being applied thereon. Preferably, the board 20 thickness is approximately 3 inches, however, it is contemplated that the thickness may vary without departing from the intended scope of the invention. Preferably, the board 20 may be in the range of 28 to 36 inches long, or more preferably in the range of 30 to 34 inches long, from the nose portion 21 to the tail portion 23. Also, preferably, the board 20 may be in the range of 12 to 24 inches wide, or more preferably in the range of 15 to 18 inches wide, from the right rail portion 25 to the left rail portion 27. However, it is contemplated that these dimensions could vary without departing from the intended scope of the invention.

The outer edge 24 extending along the perimeter of the board and the upper and lower surfaces of the board 20 may collectively define an airtight interior board chamber. An air inflation/deflation valve 26 may extend from an ambient through the outer edge 24 to the airtight interior board chamber. Alternatively, the air inflation/deflation valve 26 may extend through the upper surface or lower surface of the board 20. Preferably, the valve 26 may be a Schraeder valve or a combined Schraeder and Boston valve. The recessed area at the nose portion 21 of the board 20 may permit the valve 26 to be placed at the outer edge 24 so that it is protected from impact during use of the board.

One or more loops or other fasteners 22 may be attached to the upper surface of the board 20. The loops or fasteners 22 may be located near the corners of the board 20 and provide a means for connecting straps or lines (not shown) to the board. The straps or lines may assist a user in maintaining her balance on the board 20. With respect to FIG. 2, webbing strips 28 may be attached along the outer edge 24 at the nose and tail portions 21 and 23 of the board 20. The webbing strips 28 may provide overall reinforcement of the board 20 structure, as well as handles for carrying the board.

Figure 2:
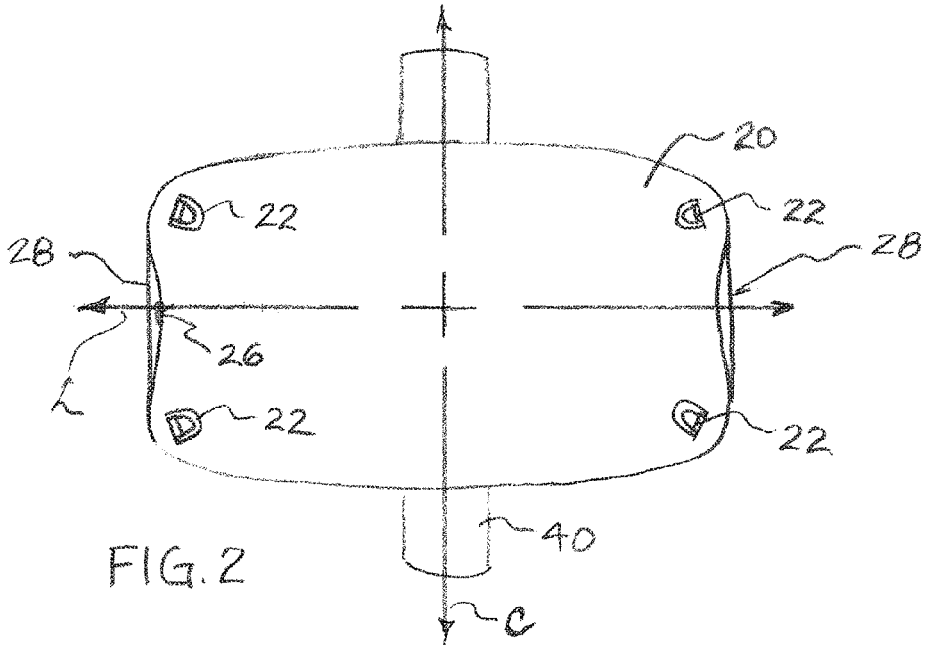
FIG. 2 is a top view of the balance board and roller set shown in FIG. 1.

With continued reference to FIGS. 1 and 2, the inflatable roller 40 may have a generally cylindrical body when the roller is fully inflated, wherein a minimum diameter of the roller when the roller is fully inflated and is not bearing the weight of a user defines a roller diameter. The inflatable roller 40 may have first and second ends disposed at opposite ends of the generally cylindrical body and an airtight interior roller chamber disposed inside the generally cylindrical body between the first and second ends. A second air inflation/deflation valve may extend from an ambient to the airtight interior roller chamber. The inflatable roller 40, including the generally cylindrical body may be adapted to support the weight of a user and the board. Further, preferably the ratio of the board 20 thickness to the roller 40 diameter is in the range 1:3 and 1:1.6 when the inflatable board and the inflatable roller are both fully inflated. Still further, preferably the roller 40 is longer than the width of the board 20 taken from right rail to left rail. Preferably the roller 40 length is in the range of lengths between the rail-to-rail width of the board 20 and the nose-to-tail length of the board. However, it is contemplated that these ratios and dimensions may vary without departing from the intended scope of the invention.

FIG. 3 illustrates a cross sectional view of the inflatable board 20 and the inflatable roller 40 taken along longitudinal centerline L (FIG. 2) extending from the nose portion 21 to the tail portion 23 in accordance with the first embodiment of the present invention when both the board and the roller are fully inflated. In this inflation state, the upper and lower surfaces of the inflatable board 20 may have a relatively flat, un-curved, shape, and the inflatable roller 40 may have a circular shape. In this inflation state, the balance trainer set may provide a pivoting distance x between the nose and tail portions 21 and 23 of the board 20 and the surface on which the inflatable roller 40 rests when the board is in a fully balanced position. Preferably, the upper and lower surfaces of the inflatable board 20 are separated by a relatively constant amount, although in this and other embodiments the separation of the two surfaces may vary.

Figure 4:
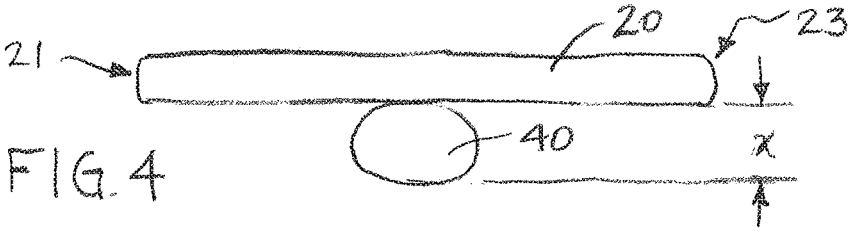
FIG. 4 is a side cross sectional view of the balance board and roller set shown in FIGS. 1-3 while in a partial inflation state.

FIG. 4 illustrates a cross sectional view of the inflatable board 20 and the inflatable roller 40 taken along longitudinal centerline L extending from the nose portion 21 to the tail portion 23 in accordance with the first embodiment of the present invention when the board is fully inflated and the roller is partially inflated. In this inflation state, the inflatable roller 40 may have a flattened rounded shape. In this inflation state, the balance trainer set may provide a pivoting distance x between the nose and tail portions 21 and 23 of the board 20 and the surface on which the inflatable roller 40 rests when the board is in a fully balanced position which is less than the distance x in FIG. 3. This inflation state of the inflatable roller 40 may also provide more resistance to a dynamic rolling motion in the nose-tail direction, making it easier to balance upon. This inflation state of the inflatable roller 40 also provides an increased contact surface area between the roller and the inflatable board 40 as well as between the roller and the surface on which it rests, making it easier to maintain balance on the roller. The lower pressure in the inflatable roller 40, as compared with the roller in FIG. 3, may also enable the user to experience some rail-to-rail balance movement by shifting her weight between the rails.

Figure 5:
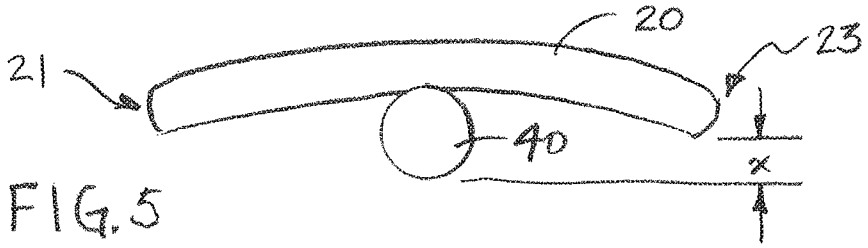
FIG. 5 is a side cross sectional view of the balance board and roller set in accordance with a second embodiment of the present invention while in a first orientation and in a full inflation state.

FIG. 5 illustrates a cross sectional view of the inflatable board 20 and the inflatable roller 40 taken along longitudinal centerline L extending from the nose portion 21 to the tail portion 23 in accordance with a second embodiment of the present invention when both the board and the roller are fully inflated. In this inflation state, the upper and lower surfaces of the inflatable board 20 may have a slightly curved shape in the nose to tail direction, and the inflatable roller 40 may have a circular shape. In this inflation state, the balance trainer set may provide a pivoting distance x between the nose and tail portions 21 and 23 of the board 20 and the surface on which the inflatable roller 40 rests when the board is in a fully balanced position which is less than the distance x in FIG. 3. Preferably, but not necessarily, the upper and lower surfaces of the inflatable board 20 are slightly curved along their entireties from the nose portion 21 to the tail portion 23. Further, preferably, but not necessarily, the upper and lower surfaces of the inflatable board 20 are curved away from the longitudinal centerline L symmetrically towards the nose and tail portions 21 and 23. Still further, preferably, but not necessarily, the upper and lower surfaces of the inflatable board 20 are slightly curved to the same degree.

Figure 6:
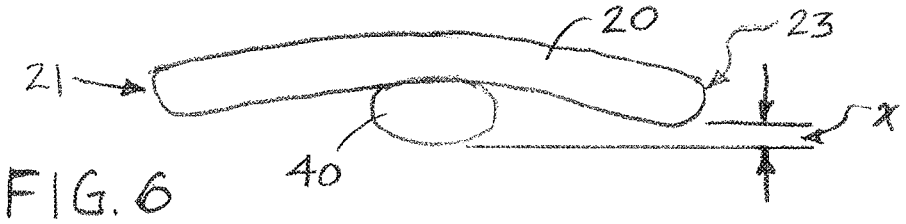
FIG. 6 is a side cross sectional view of the balance board and roller set shown in FIG. 5 while in a first orientation and in a partial inflation state.

FIG. 6 illustrates a cross sectional view of the inflatable board 20 and the inflatable roller 40 taken along longitudinal centerline L extending from the nose portion 21 to the tail portion 23 in accordance with the second embodiment of the present invention when the board is fully inflated and the roller is partially inflated. In this inflation state, the inflatable roller 40 may have a flattened rounded shape. In this inflation state, the balance trainer set may provide a pivoting distance x between the nose and tail portions 21 and 23 of the board 20 and the surface on which the inflatable roller 40 rests when the board is in a fully balanced position, which is less than the distance x in FIG. 5. As with the embodiment shown in FIG. 4, this inflation state of the inflatable roller 40 may provide more resistance to a dynamic rolling motion in the nose-tail direction, making it easier to balance upon. This inflation state of the inflatable roller 40 also provides an increased contact surface area between the roller and the inflatable board 40 as well as between the roller and the surface on which it rests, making it easier to maintain balance on the roller. The lower pressure in the inflatable roller 40, as compared with the roller in FIG. 5, may also enable the user to experience some rail-to-rail balance movement by shifting her weight between the rails.

Figure 7:
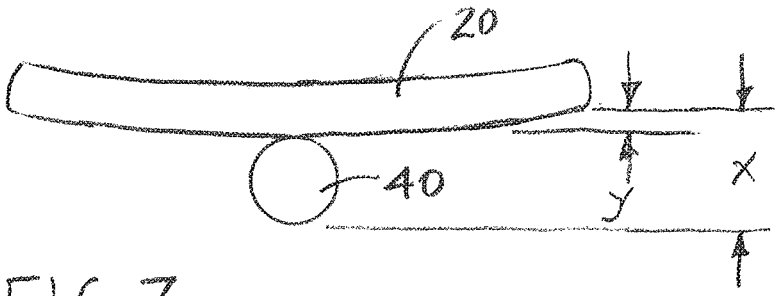
FIG. 7 is a side cross sectional view of the balance board and roller set shown FIGS. 5 and 6 while in a second orientation and in a full inflation state.

FIG. 7 illustrates a cross sectional view of the inflatable board 20 and the inflatable roller 40 taken along longitudinal centerline L extending from the nose portion 21 to the tail portion 23 in accordance with the second embodiment of the present invention when the board is fully inflated and the roller is partially inflated. In Fig. the inflatable board 20 is in an inverted orientation as compared with the orientation in FIG. 5. In this orientation, the balance trainer set may provide a pivoting distance x between the nose and tail portions 21 and 23 of the board 20 and the surface on which the inflatable roller 40 rests when the board is in a fully balanced position, which is considerably greater than the distance x in FIG. 5. The distance y is the elevation of the outer edge of the lower surface of the tail portion 23 (and potentially the nose portion 21) of the inflatable board 20 above the lateral centerline C (FIG. 2) of the lower surface, also referred to as the "rocker" amount. By inverting the inflatable board between the orientations shown in FIGS. 7 and 5, the pivoting distance x may be varied by the amount of 2y enabling the same balance trainer set to provide varied degrees of balancing difficulty. The further variation of the inflation state of the inflatable roller 40 in combination with inversion of the board 20 enables an almost infinite degree of both dynamic (rolling) and static (pivoting) balance difficulty in both the nose-to-tail and the rail-to-rail directions.

Figure 8:
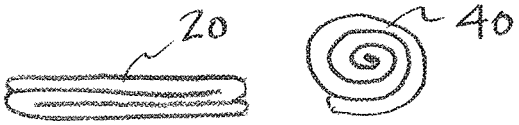
FIG. 8 is a side view of the balance board and roller set shown in accordance with all embodiments of the present invention in a deflated and folded/rolled state.

FIG. 8 illustrates the inflatable board 20 and the inflatable roller 40 in deflated folded and/or rolled-up states.

Figure 9:
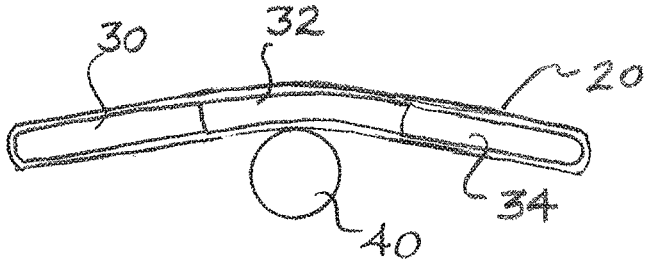
FIG. 9 is a cross sectional side view of a balance board and roller set in accordance with a third embodiment of the invention while in a partial inflation state.

FIG. 9 illustrates a cross sectional view of the inflatable board 20 and the inflatable roller 40 taken along longitudinal centerline L extending from the nose portion 21 to the tail portion 23 in accordance with a third embodiment of the present. The inflatable board 20 may have a plurality of airtight interior board chambers 30, 32 and 34 disposed between the first surface, the second surface, and the outer edge of the board. In this embodiment, the upper and lower surfaces of the inflatable board 20 may have a slightly curved shape (shown) or a flat shape.

Figure 10:
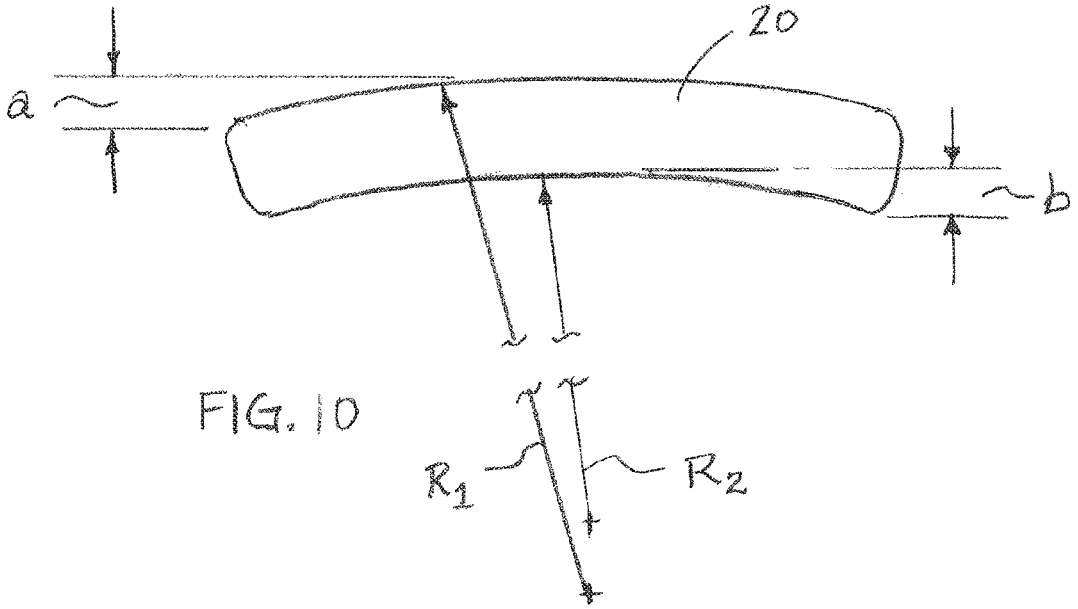
FIG. 10 is illustrative of the radii of curvature of the upper and lower surfaces of a balance board in accordance with various embodiments of the present invention.

FIG. 10 is a cross sectional view taken along a longitudinal centerline of the inflatable board 20 of the second embodiment which illustrates radii of curvatures $R_1$ and $R_2$ of the upper and lower surfaces, respectively. It is appreciated that the orientation of the inflatable board 20, as shown in FIG. 10, could be inverted so that $R_1$ is the radius of curvature of the lower surface and $R_2$ is the radius of curvature of the upper surface. Preferably, the radii of curvatures $R_1$ and $R_2$ are in the range of 36 to 240 inches, more preferably in the range of 56 to 144 inches, and still more preferably approximately 76 inches. When the radii of curvatures $R_1$ and $R_2$ are in these ranges, they may provide a convex (rocker) elevation a of the upper surface of the inflatable board 20 and a concave (rocker) depression b of the board in the nose-to-tail direction in the range of: 3.3 to 0.5 inches, 2 to 0.8 inches, and approximately 1.5 inches, respectively, assuming the board is approximately 30 inches long from the nose portion 21 to the tail portion 23.

Figure 11:
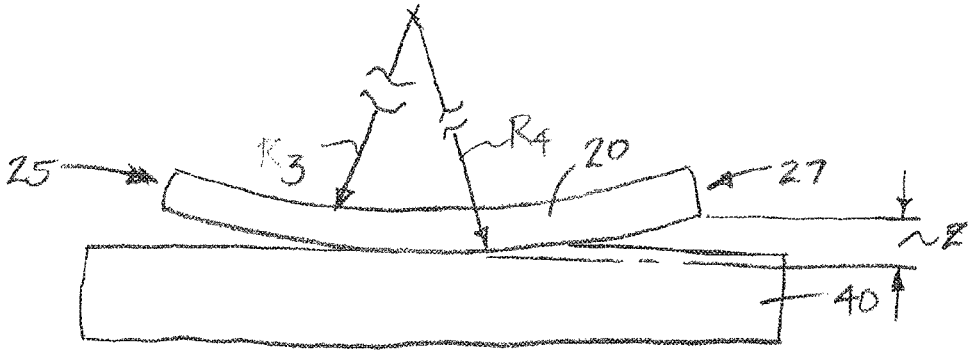
FIG. 11 is a cross sectional front view of a balance board and roller set in accordance with a fourth embodiment of the invention while in a full inflation state.

FIG. 11 illustrates a cross sectional view of the inflatable board 20 and the inflatable roller 40 taken along lateral centerline extending from the right rail portion 25 to the left rail portion 27 in accordance with a fourth embodiment of the present invention when both the board and the roller are fully inflated. In this inflation state, the upper and lower surfaces of the inflatable board 20 may have a slightly curved shape in the rail-to-rail direction, and the inflatable roller 40 may have a circular shape. The inflatable board 20 of FIG. 11 may also have, or not have, a slightly curved shape in the nose-to-tail direction. In this inflation state, the balance trainer set may provide a pivoting (rocker) distance z between the right rail and left rail portions 25 and 27 of the board 20 and the inflatable roller 40. Preferably, but not necessarily, the upper and lower surfaces of the inflatable board 20 are slightly curved along their entireties from the right rail portion 25 to the left rail portion 27. Further, preferably, but not necessarily, the upper and lower surfaces of the inflatable board 20 are curved away from the lateral centerline of the board symmetrically towards the right rail and left rail portions 25 and 27. Still further, preferably, but not necessarily, the upper and lower surfaces of the inflatable board 20 are slightly curved to the same degree.

With continued reference to FIG. 11, radii of curvatures $R_3$ and $R_4$ of the upper and lower surfaces, respectively, of the inflatable board 20 of the fourth embodiment are also illustrated. Preferably, the radii of curvatures $R_3$ and $R_4$ are in the range of 36 to 144 inches, and more preferably approximately 72 inches. When the radii of curvatures $R_3$ and $R_4$ are in these ranges, they may provide a convex (rocker) elevation z of the lower surface of the board 20 in the range of: 1 to 0.25 inches, and approximately 0.5 inches, respectively, assuming the board is approximately 17 inches wide from the right rail portion 25 to the left rail portion 27.

As will be understood by those skilled in the art, the invention may be embodied in other specific forms without departing from the spirit or essential characteristics thereof. The elements and method steps described above are provided as illustrative examples of one technique for implementing the invention; one skilled in the art will recognize that many other implementations are possible without departing from the present invention as recited in the claims. For example, the shapes and sizes of the inflatable balance board and roller may vary without departing from the intended scope of the present invention. Further, while the preferred material for constructing an inflatable balance board and/or inflatable roller is drop-stitch material, this material may be varied without departing from the intended scope of the present invention. Accordingly, the disclosure of the present invention is intended to be illustrative, but not limiting, of the scope of the invention. It is intended that the present invention cover all such modifications and variations of the invention, provided they come within the scope of the appended claims and their equivalents.

What is claimed is:

1. An inflatable balance board and inflatable roller set comprising:

the inflatable board having:

a first surface extending between nose, tail, right rail and left rail portions of the board, wherein the first surface is slightly curved along a section extending between the nose and the tail portions from a lateral centerline when the board is fully inflated without the weight of a user being applied thereon, a second surface opposing the first surface and substantially the same dimension as the first surface, wherein a minimum distance between opposing central portions of the first surface and the second surface define a board thickness when the board is fully inflated without the weight of a user being applied thereon, an outer edge extending along a perimeter of the board between the first surface and the second surface, an airtight interior board chamber disposed between the first surface, the second surface, and the outer edge, and a first air inflation/deflation valve extending from an ambient to the airtight interior board chamber;

wherein the first and second surfaces are adapted to support the weight of a user when the board is placed against the inflatable roller; and the inflatable roller having:

a generally cylindrical body when the roller is fully inflated, wherein a minimum diameter of the roller when the roller is fully inflated defines a roller diameter, first and second ends disposed at opposite ends of the generally cylindrical body, an airtight interior roller chamber disposed inside the generally cylindrical body between the first and second ends, and a second air inflation/deflation valve extending from an ambient to the airtight interior roller chamber; and wherein the cylindrical body is adapted to support the weight of a user and the board.

2. The inflatable balance board and inflatable roller set of claim 1, wherein the first surface is slightly curved along its entirety between the nose and the tail portions.

3. The inflatable balance board and inflatable roller set of claim 2, wherein the second surface is slightly curved to the same degree as the first surface.

4. The inflatable balance board and inflatable roller set of claim 3, wherein, when the inflatable roller extends between the right rail and the left rail portions of the inflatable board, and when the inflatable roller is less than fully inflated, the set provides a user with dynamic balance movement in a nose-to-tail direction and static balance movement in a rail-to-rail direction.

5. The inflatable balance board and inflatable roller set of claim 4, wherein the inflatable board has a plurality of airtight interior board chambers disposed between the first surface, the second surface, and the outer edge.

6. The inflatable balance board and inflatable roller set of claim 1, wherein the second surface is slightly curved to the same degree as the first surface.

7. The inflatable balance board and inflatable roller set of claim 6, wherein, when the inflatable roller extends between the right rail and the left rail portions of the inflatable board, and when the inflatable roller is less than fully inflated, the set provides a user with dynamic balance movement in a nose-to-tail direction and static balance movement in a rail-to-rail direction.

8. The inflatable balance board and inflatable roller set of claim 1, wherein the inflatable board has a plurality of airtight interior board chambers disposed between the first surface, the second surface, and the outer edge.

9. The inflatable balance board and inflatable roller set of claim 8, wherein a separate air inflation/deflation valve extends from an ambient to each of the plurality of airtight interior board chambers.

10. The inflatable balance board and roller set of claim 1, wherein the ratio of the board thickness to the roller diameter is in the range 1:3 and 1:1.6 when the inflatable board and the inflatable roller are both fully inflated.

11. The inflatable balance board and inflatable roller set of claim 1, wherein a radius of curvature of the first surface along a section extending between the nose and the tail portions from a lateral centerline when the board is fully inflated without the weight of a user being applied thereon is in the range of 36 to 240 inches.

12. The inflatable balance board and inflatable roller set of claim 1, wherein the first surface is slightly curved along a section extending between the right rail and the left rail portions from a longitudinal centerline when the board is fully inflated without the weight of a user being applied thereon.

13. The inflatable balance board and inflatable roller set of claim 12, wherein the second surface is slightly curved to the same degree as the first surface.

14. The inflatable balance board and inflatable roller set of claim 13, wherein a radius of curvature of the first surface along a section extending between the right rail and the left rail portions from a longitudinal centerline when the board is fully inflated without the weight of a user being applied thereon is in the range of 36 to 240 inches.

15. The inflatable balance board and inflatable roller set of claim 1, wherein, when the inflatable roller extends between the right rail and the left rail portions of the inflatable board, and when the inflatable roller is less than fully inflated, the set provides a user with dynamic balance movement in a nose-to-tail direction and balance movement in a rail-to-rail direction.

* * * * *